US007544048B2

(12) United States Patent
Lishanski et al.

(10) Patent No.: US 7,544,048 B2
(45) Date of Patent: Jun. 9, 2009

(54) UNIVERSAL VIBRATORY PUMP

(76) Inventors: Grigori Lishanski, 10112 W. Sharon La., Apt. 1, Milwaukee, WI (US) 53225; Oleg Lishanski, 805 Weidner Ct., Buffalo Grove, IL (US) 60089

( * ) Notice: Subject to any disclaimer, the term of this patent is extended or adjusted under 35 U.S.C. 154(b) by 761 days.

(21) Appl. No.: 10/655,340

(22) Filed: Sep. 4, 2003

(65) Prior Publication Data

US 2009/0116986 A1 May 7, 2009

(51) Int. Cl.
*F04B 17/00* (2006.01)
*F04B 43/00* (2006.01)

(52) U.S. Cl. ..... 417/415; 417/479; 417/416; 417/412; 417/413.1; 417/212

(58) Field of Classification Search ..... 417/491, 417/531, 534, 415, 442, 493, 212, 416, 395, 417/412, 413.1, 479, 480, 560
See application file for complete search history.

(56) References Cited

U.S. PATENT DOCUMENTS

| | | | | |
|---|---|---|---|---|
| 76,318 | A | 4/1868 | Fisher | |
| RE10,255 | E | 12/1882 | Worthen | |
| 475,296 | A | 5/1892 | Chamberlin | |
| 1,529,384 | A | 3/1925 | Adams | |
| 2,038,155 | A | 4/1936 | Aldridge | |
| 2,634,684 | A | 4/1953 | Alvarez et al. | |
| 2,732,806 | A | 1/1956 | Alvarez et al. | |
| 4,147,476 | A | 4/1979 | Warren | |
| 4,154,375 | A * | 5/1979 | Bippus | 222/325 |
| 4,737,083 | A * | 4/1988 | Meyer | 417/413.1 |
| 4,755,194 | A | 7/1988 | Rooker et al. | |
| 4,815,948 | A | 3/1989 | Aurelio | |
| 4,938,384 | A * | 7/1990 | Pilolla et al. | 222/52 |
| 4,990,066 | A * | 2/1991 | Kern | 417/307 |
| 5,002,471 | A | 3/1991 | Perlov | |
| 5,147,535 | A | 9/1992 | Bernhardt | |
| 5,150,841 | A * | 9/1992 | Silvenis et al. | 239/332 |
| 5,165,871 | A | 11/1992 | Iwabuchi | |
| 5,681,152 | A * | 10/1997 | Ahs | 417/413.2 |
| 5,716,007 | A * | 2/1998 | Nottingham et al. | 239/332 |
| 5,921,759 | A | 7/1999 | Khan | |
| 6,280,148 | B1 | 8/2001 | Zengerlee et al. | |
| 6,315,533 | B1 | 11/2001 | Lishanski et al. | |
| 6,364,622 | B1 * | 4/2002 | Lishanski et al. | 417/53 |
| 6,401,752 | B1 * | 6/2002 | Blackbourn et al. | 137/588 |
| 6,428,289 | B1 * | 8/2002 | Lishanski et al. | 417/415 |
| 6,604,920 | B1 * | 8/2003 | Lishanski et al. | 417/491 |

* cited by examiner

*Primary Examiner*—Devon C Kramer
*Assistant Examiner*—Leonard J Weinstein
(74) *Attorney, Agent, or Firm*—Boyle Fredrickson, SC

(57) ABSTRACT

A vibratory pumping machine including a pumping chamber disposed within a housing for the machine having an inlet tube that is insertable into a container having a liquid therein to withdraw the liquid from the container upon actuation of the pumping mechanism also located within the housing. The chamber includes an oscillating rod that engages a resilient outlet member to form a vacuum within the chamber which draws the liquid upwardly through the tube into the chamber for dispensing through the outlet member. A mechanism including the pumping chamber can be utilized to withdraw liquids from within container of various shapes and sizes, as well as to introduce other fluids, such as gases, into containers containing such liquids.

10 Claims, 5 Drawing Sheets

UNIVERSAL VIBRATORY PUMP

FIELD OF THE INVENTION

The present invention relates to vibratory pumps, and more specifically to a universal vibratory pump including a pumping mechanism that does not need to be submerged in the fluid to be dispensed from the pump.

BACKGROUND OF THE INVENTION

In order to mechanically transfer a fluid from the first location to a second location, a wide variety of pumping mechanisms can be utilized. With specific regard to vibratory pumps, highly effective vibratory pump mechanisms are disclosed in each of commonly-owned U.S. Pat. Nos. 6,315,533; 6,364,622; 6,428,289; and 6,604,920; which are each incorporated herein by reference. In each of these patents, the vibratory pump mechanisms each include a casing or housing that is spaced from the vibration mechanism or generator and submerged within the fluid to be transferred. The operation of the vibration generator in the pump mechanism then operates the pump components located in the casing to drive the fluid into the casing in order to direct the fluid through an outlet hose connected to the casing which terminates at the location where it is desired to transfer the fluid.

However, in certain situations the fluid to be transferred is located within a container in which the casings for the previously-known vibratory pumps cannot be inserted. As a result, in these situations it is very difficult, if not impossible, to transfer the fluid from within the container to the desired location in a fast and easy manner using a previously-known vibratory pump.

Therefore, it is desirable to develop a universal vibratory pump design which enables the fluid held within virtually any container, including those having a relatively small size opening, to be transferred from the container to a desired location. It is further desirable that the various parts of the pump mechanism including the vibration generator and pumping components can be contained within a relatively small volume or housing to enable the vibratory pump to be utilized in a wide variety of applications.

SUMMARY OF THE INVENTION

According to a primary aspect of the present invention, the universal vibratory pump includes a pumping chamber having an outlet end and an inlet end. The outlet end includes an outlet chamber that extends out of the pumping chamber to direct outgoing fluid from the chamber. The inlet end comprises an elongate tube extending outwardly from the chamber that is insertable into a container holding the fluid to be transferred. The inlet tube extending from the outlet chamber can be any length or diameter needed, enabling the pump to be utilized with containers having virtually any size or shape.

A vibration generating mechanism is located adjacent the pumping chamber and is connected to a plunger which extends into the chamber in alignment with the outlet end. Due to the operation of the vibration mechanism, the plunger is oscillated and repeatedly contacts the outlet end of the pumping chamber to close and create a temporary vacuum within the chamber, thereby drawing the fluid from the container upwardly through the inlet tube and into the pumping chamber for dispensing through the outlet end.

According to another aspect of the invention, the pumping chamber can be formed separately for use as an attachment for an existing vibratory pump in order to convert a pump previously adapted for use by submerging the pump within the fluid to be transferred to a pump which uses the inlet tube to withdraw the fluid from the container.

According to still another aspect of the present invention, the inlet tube can be attached to a fluid supply, and the outlet end can be inserted into a container holding another fluid such that when the pump is operated, the first fluid moves through the pumping chamber and is injected into the fluid in the container in order to quickly and effectively introduce and mix the fluids as desired.

Numerous other features, advantages and objects of the invention will be made apparent from the following detailed description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
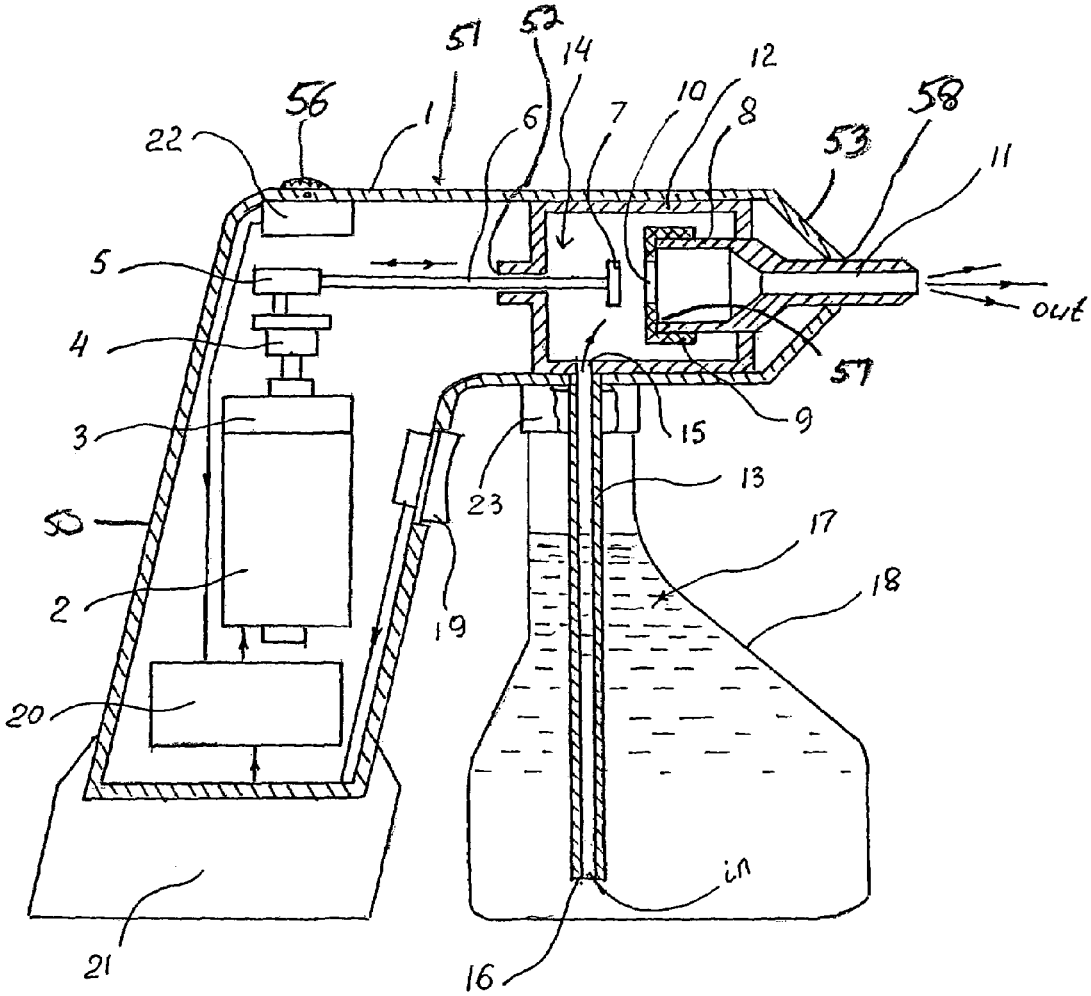
FIG. 1 is a side cross-sectional view of a vibratory pump including the pumping chamber constructed according to the present invention.

With reference now to the drawing figures in which like reference numerals designate like parts throughout the disclosure, a vibratory pump is indicated generally at 1 in FIG. 1. The pump 1 includes an electromotor 2 operably connected to a reducer 3. The reducer 3 is in turn connected to a mechanism 4 as is known in the art capable of transforming the rotation of the reducer 3 into oscillating motion for a rod 6 utilizing a hinge 5. Opposite the hinge 5, the rod 6 includes a plate 7. The hinge 5 can also be omitted in those embodiments of the present invention where the components of the pump 1 are all disposed linearly with respect to one another.

The electromotor 2, reducer 3, mechanism 4 and hinge 5 are each contained within a handle portion 50 of a housing 51 of the vibrating pump 1, with the rod 6 extending through an opening 52 into a pumping chamber 12 disposed within a nozzle portion 53 of the housing 51. The opening 52 also preferably includes a sealing member (not shown) that prevents any liquid from passing from the pumping chamber 12 into the handle portion 50, while allowing the rod 6 to slide easily with respect to the sealing member. In order to operate the electromotor 2, the motor 2 is operably connected to a voltage controller 20 which in turn is connected to a battery 21 releasably connected to the voltage controller 20 and to the handle portion 30 of the housing 51 in a known manner. A switch or trigger 19 is disposed on the exterior of the handle portion 50 and can be depressed in order to enable the battery 21 to supply a voltage through the voltage controller 20 to the motor 2. When the switch 19 is depressed, the frequency at which the electromotor 2 operates to oscillate the rod 6 can be adjusted utilizing a controller 22 on the handle portion 20 that is connected to the voltage controller 20 and has a rotatable knob 56 disposed on the exterior of the housing 51. By rotating the knob 56, the frequency of the voltage supplied by the voltage controller 20 to the electromotor 2 can be increased or decreased to adjust the frequency of the oscillation of the rod 6 as desired.

The pumping chamber 12 is disposed adjacent an outlet 58 of the nozzle portion 53 of the housing 51 and is formed of a material that is impervious to liquid. The rod 6 extends through the opening 52 in the chamber 12 such that the plate 7 is positioned adjacent an outlet chamber 8 also disposed partially within the chamber 12. The outlet chamber 8 includes a wide inner end 57 over which is positioned a diaphragm 9 formed of a liquid-impervious, flexible material, such as a rubber, and having an aperture 10 disposed in the center of the diaphragm 9. The positioning of the diaphragm 9 is such that when the rod 6 is moved by the hinge 5 into the chamber 12 to its furthermost extent, the plate 7 contacts and compresses the diaphragm 9, forming a fluid tight seal around the aperture 10 between the plate 7 and diaphragm 9 and pushing the diaphragm 9 into the inner end 57.

Opposite the diaphragm 9, the outlet chamber 8 also includes a narrow outer end 11 that extends through the outlet 58 of the nozzle portion 53 of the housing 31 and is utilized as an outlet nozzle for the fluid dispensed from the pumping chamber 12.

The chamber 12 is also formed with an inlet opening 15 spaced from the outlet chamber 8 and the rod opening 52 in alignment with a channel 16 formed within an inlet tube 13 extending outwardly from the nozzle portion 53. The tube 13 is shown integrally formed with the nozzle portion 53 of the housing 51 and extends outwardly from the pump 1 in a direction generally perpendicular to the rod 6. Alternatively, the tube 13 can be removably secured to the housing 51 to enable tubes 13 of various sizes to be used with the pump 1, or the tube 13 can extend outwardly at an angle with respect to the pump 1, in order to enable the pump 1 to be utilized in a horizontal configuration with containers having angled openings. The tube 13 can also be formed of a flexible material different than that used to form the housing 51, so that the tube 13 can flex both while the tube 13 is inserted into a container and while the pump 1 is in operation.

Around the tube 13, an internally threaded sleeve 23 is integrally formed on the nozzle portion 53. The sleeve 23 is matable with an externally threaded neck 39 of a container 18 such that the tube 13 can be inserted into the container 18 which is then fixed to the pump housing 31. The liquid 17 held within the container 18 can then be dispensed by the pump 1 by activating the electromotor 2 using the switch 19 to oscillate the rod 6 into and out of engagement with the outlet chamber 8, thereby creating the vacuum in the member 8 to draw the liquid 17 upwardly through the tube 13 into the pumping chamber 12 and pressing the liquid 17 out of the chamber 8 using the diaphragm 9 for disbursement through the outlet 58.

Figure 2:
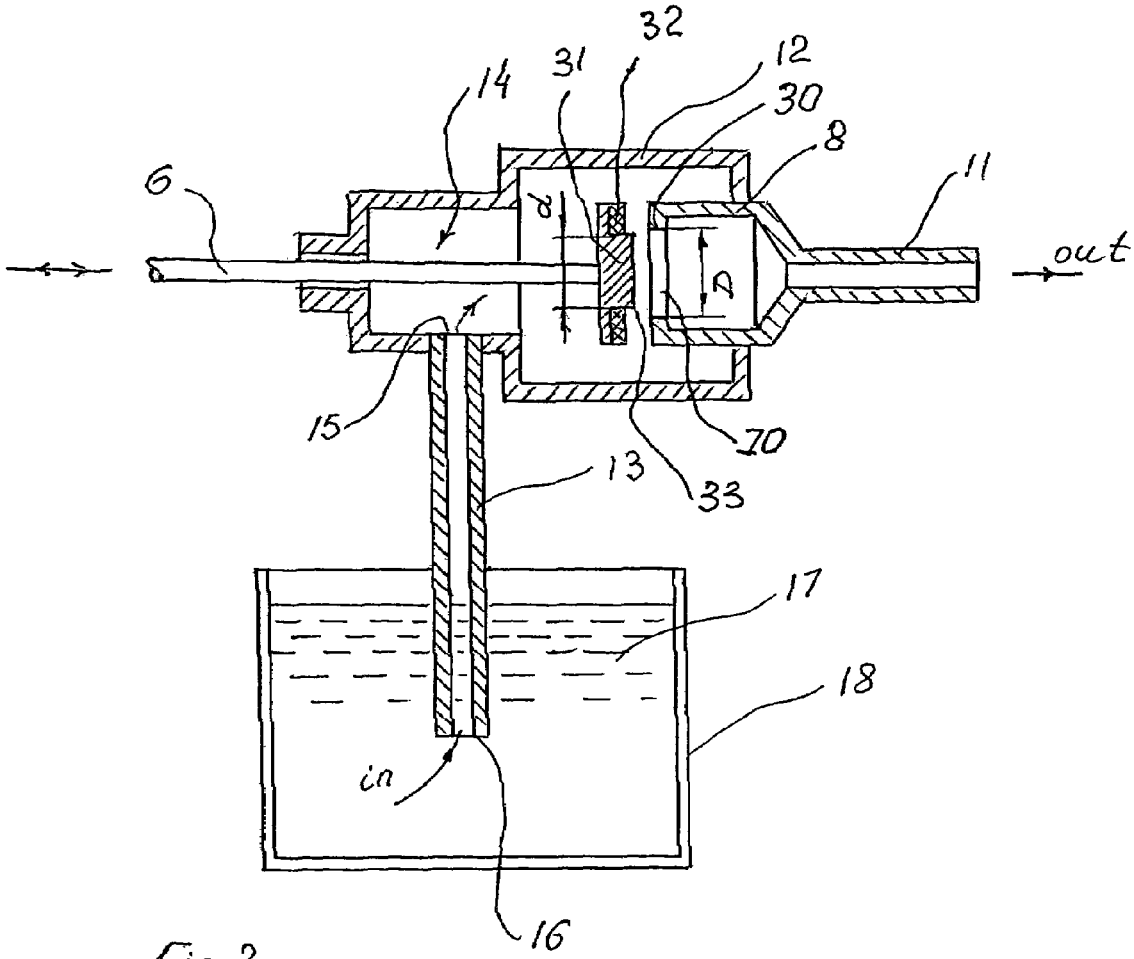
FIG. 2 is a side cross-sectional view of a first alternate embodiment of the plunger and outlet chamber of FIG. 1.

Referring now to FIG. 2, in an alternative embodiment of the plate 7 and chamber 8, the plate 7 on the rod 6 is replaced by a plate 31 including a generally circular center portion 33 and a rubber O-ring 32 positioned around the center portion 33. Also in this embodiment, the diaphragm 9 is omitted from the outlet chamber 8 such that the outlet chamber 8 includes only an aperture 70 having a diameter D slightly greater than the diameter d of the center portion 33 of the plate 31. In operation, the O-ring 32 engages the periphery of the aperture 70 when the plate 31 contacts the outlet chamber 8, thereby effectively sealing the plate 31 against the outlet chamber 8. Also, in this embodiment the pump chamber 12 is formed as a separate unit from the housing 51, such that the chamber 12 can be used as an attachment for existing vibratory pumps having oscillating plungers or plates 7.

Figure 3:
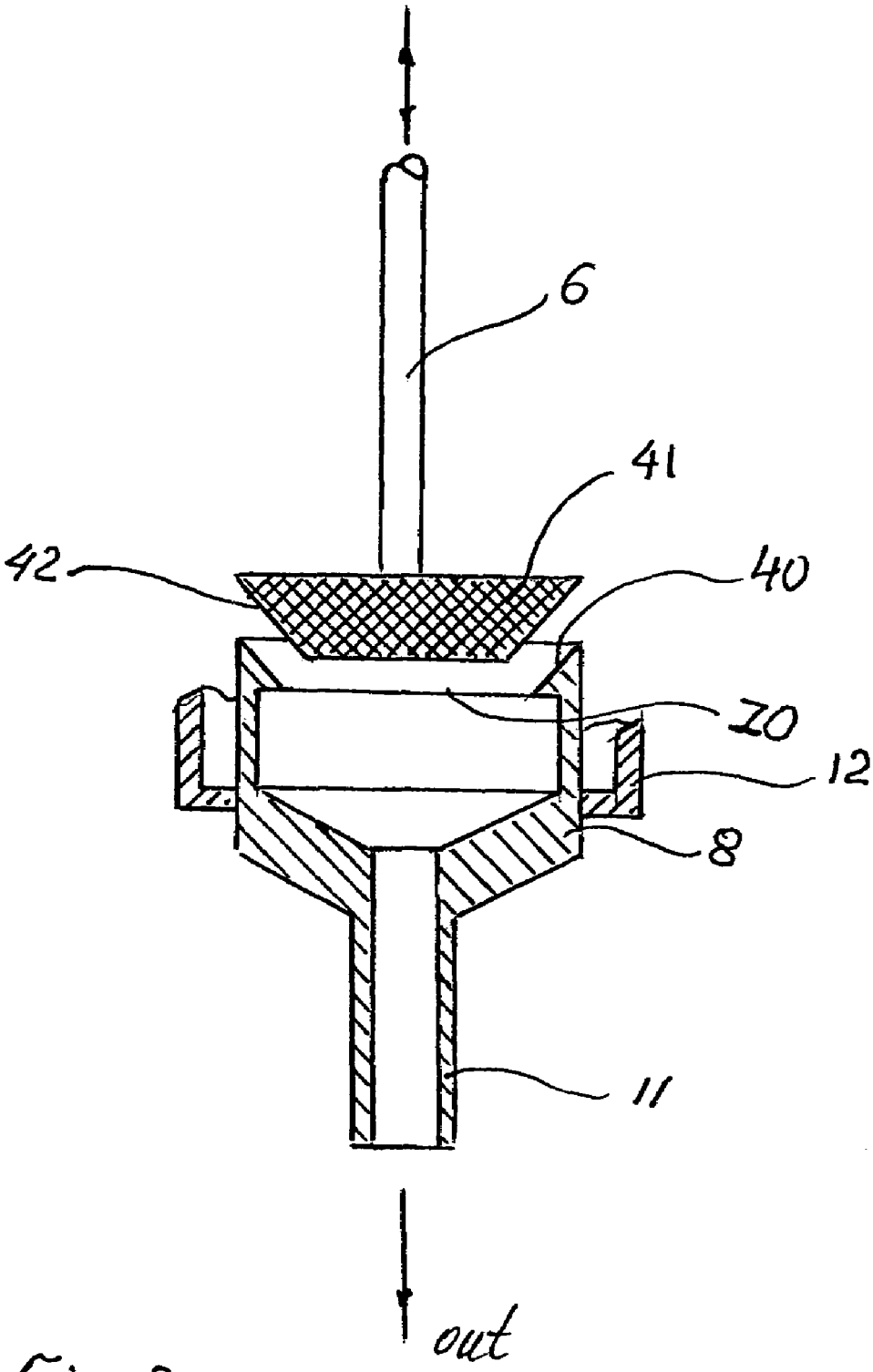
FIG. 3 is a side cross-sectional view of a second alternate embodiment of the plunger and outlet chamber of FIG. 1.

In still another embodiment of the present invention, as best shown in FIG. 3, the outlet chamber 8 can include a tapered or conical wall 40 surrounding the aperture 70 that is engageable with a correspondingly tapered or conical plate 41 having a conical surface 42 matable with the tapered wall 40. The plate 41 is preferably formed of a resilient material to enable the plate 41 to form a watertight seal with the wall 40 and also to compress the liquid held in the chamber 8.

Figure 4:
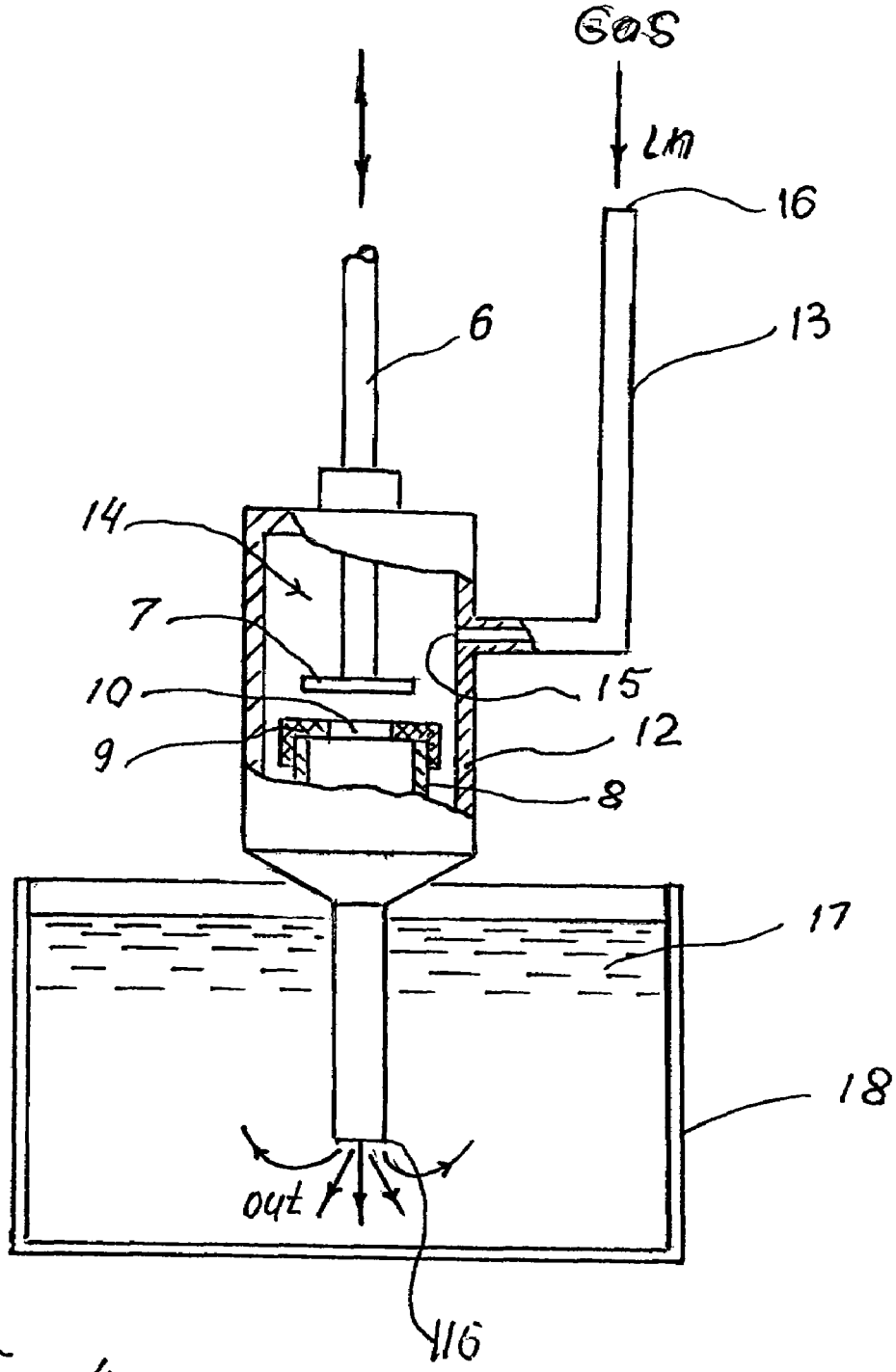
FIG. 4 is a partially broken away isometric view of the pumping chamber of FIG. 1 used to inject a gas into a liquid.

Pursuant to still another embodiment of the present invention, as best shown in FIG. 4, the tube 13 can be formed to extend in a non-linear, and preferably a generally L-shaped manner from the pumping chamber 12 such that a supply of a gas (not shown) can be attached opposite the pumping chamber 12 of the tube 13. The outlet chamber 8 may then be positioned partially within an amount of liquid 17 in a container 18 such that, by the operation of the electromotor 2 to oscillate the rod 6, the gas can be pumped into and through the pumping chamber 12 and out of the outlet 116 into the liquid 17 in the container 18. The gas supply can also be switched to a fluid supply or supplies as desired, with each supply connected to the pumping chamber 12 to mix all of the fluids with one another in the container 18.

Figure 5:
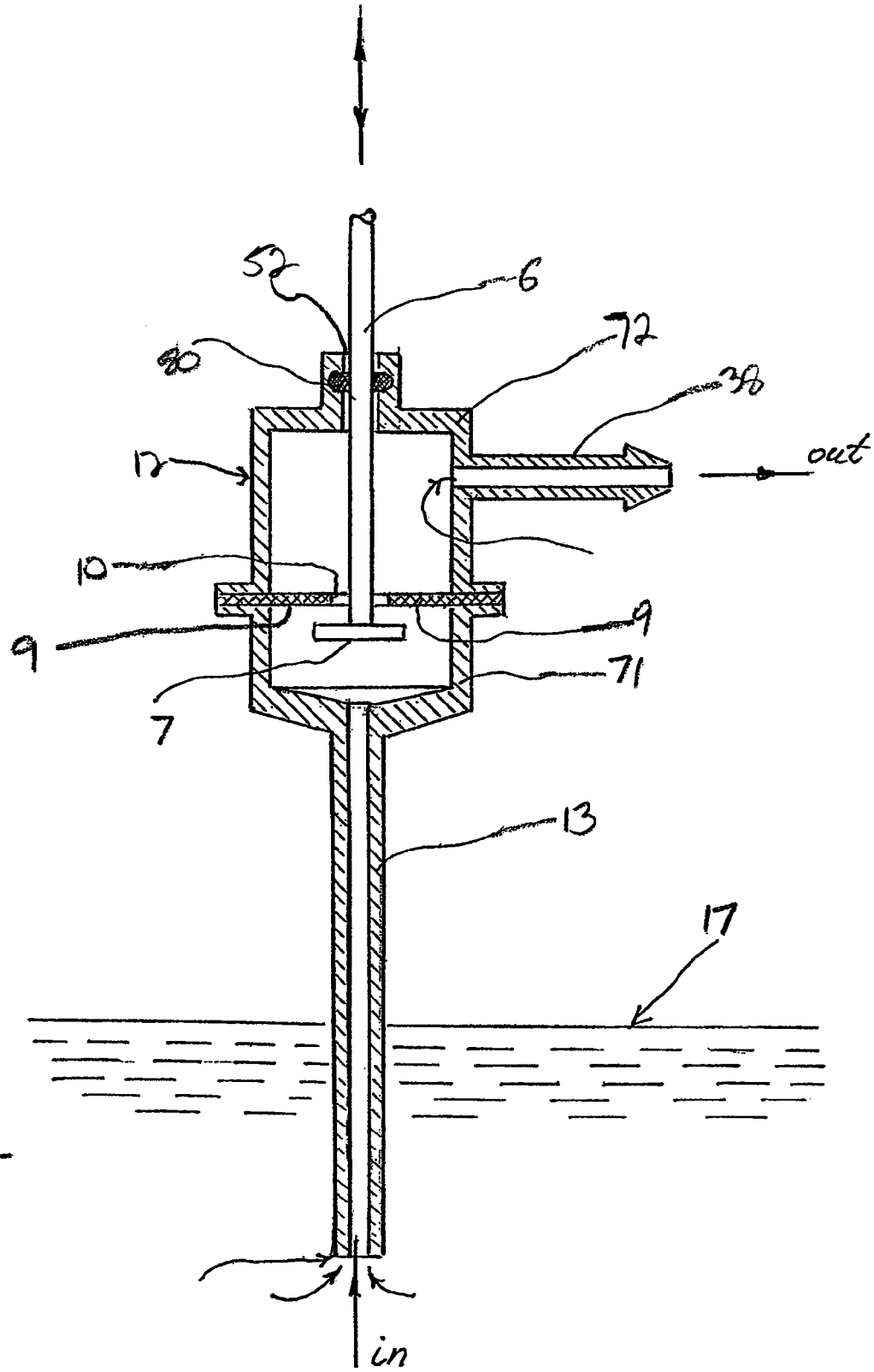
FIG. 5 is a cross-sectional view of a second alternate embodiment of the plunger of FIG. 1.

Further, as best shown in FIG. 5, the chamber 12 can be constructed of an inlet portion 71 and an outlet portion 72 that are secured to one another and sandwich the diaphragm 9 therebetween to make the chamber 12 fluid-tight. The inlet portion 71 includes the inlet tube 13, while the outlet portion 72 includes the outlet 38 and a rod opening 52 through which extends the rod 6. The rod 6 engages a sealing member 80 disposed in the opening 52 to ensure that no fluid from the inlet tube 13 flows out of the chamber 12 except through the outlet 38. However, in this embodiment the plate 7 is positioned on the side of the diaphragm 9 adjacent the outlet 38, such that the rod 6 extends through the aperture 10. In operation, the rod 6 and plate 7 alternately pull the diaphragm 9 towards the outlet 38 and release the diaphragm 9 to produce the vibratory pumping action within the chamber 12.

Having described the preferred embodiments of the pumping mechanism and vibratory pump of the present invention, a number of additional embodiments will now also be discussed. With regard to the embodiment of FIG. 1, the various operating components of the pump 1 may also be positioned within a housing 51 having other than the illustrated shape. For example, the housing 51 can be shaped for insertion into and securing within a filling opening (not shown) of a large tank (not shown). The shape of this embodiment of the housing 51 allows the inlet tube 13 to be positioned within a fluid held within the tank, while the outlet 58 can be positioned outside of the tank or connected to a hose (not shown) or other member capable of directing the fluid from the tank to a desired location.

Also, due to the ability of the pump 1 to transfer fluid, the pump 1 can be utilized as a fluid-jet engine in which a fluid is introduced through the inlet tube 13 to the pump 1 and directed out of the outlet 58 into another fluid, thereby propelling a vehicle to which the pump 1 is secured.

Various alternatives are contemplated as being within the scope of the following claims particularly pointing out and distinctly claiming the subject matter regarded as the invention.

We hereby claim:

1. A vibratory pump comprising:

a) a rigid housing;

b) a vibration generating mechanism disposed within the housing;

c) a rigid pumping chamber disposed within the housing adjacent the vibration generating mechanism and defining an enclosed interior space, the pumping chamber including at least one fluid inlet and a fluid outlet each extending through the pumping chamber, the at least one fluid inlet communicating with the interior space through an inlet opening in the pumping chamber and extending outwardly from the pumping chamber, the at least one fluid inlet adapted to be inserted into a fluid to be pumped to draw the fluid into the pumping chamber within the housing; and d) a rod disposed within the housing and operably connected to the vibration generating mechanism at one end to enable the rod to move in direct correspondence to the oscillation of the vibration generating mechanism and positioned within the pumping chamber at the opposite end, the opposite end selectively and directly engageable with the fluid outlet during operation of the vibration generating mechanism, wherein the fluid outlet includes an enclosed outlet chamber defining an enclosed inner space and having an inner end positioned within the enclosed interior space within the pumping chamber and including a central opening, and an outer end extending outwardly from the enclosed interior space within the pumping chamber, wherein the rod includes a plate opposite the vibration generating mechanism that is engageable with the central opening, wherein the plate includes a central portion having a diameter less than the diameter of the central opening and an outer portion having a diameter greater than the diameter of the central opening, and wherein the outer portion includes a sealing member that is sealingly engageable with the inner end of the outlet chamber.

2. The pump of claim 1 wherein the central opening has a conical surface.

3. The pump of claim 2 wherein the rod includes a plate opposite the vibration generating mechanism that is matable with the central opening.

4. The pump of claim 3 wherein the plate is formed of a resilient material.

5. The pump of claim 1 wherein the inner end includes a resilient diaphragm positioned over the central opening, the diaphragm including a central aperture.

6. The pump of claim 1 wherein the plate is positioned within the inner end of the outlet chamber.

7. The pump of claim 1 wherein the at least one fluid inlet is formed as at least one inlet tube that extends outwardly from the pumping chamber.

8. The pump of claim 7 wherein the at least one inlet tube is formed from a generally resilient material.

9. The pump of claim 7 wherein the housing includes an engagement member disposed on the housing that is engageable with a fluid-holding container.

10. The pump of claim 1 wherein the vibration generating mechanism includes a switch extending through the housing.

* * * * *